US005211209A

United States Patent [19]

Geibel et al.

[11] Patent Number: 5,211,209

[45] Date of Patent: May 18, 1993

[54] REVERSIBLE DIRECTION WIRE TWISTING PLIERS

[75] Inventors: Ronald J. Geibel; Maureen A. Geibel, both of Schaumburg, Ill.

[73] Assignee: Milbar Corporation, Chagrin Falls, Ohio

[21] Appl. No.: 801,035

[22] Filed: Dec. 2, 1991

[51] Int. Cl.[5] ..... B21F 7/00

[52] U.S. Cl. ..... 140/118; 140/121

[58] Field of Search ..... 140/118, 119, 121, 122

[56] References Cited

U.S. PATENT DOCUMENTS

| | | | |
|---|---|---|---|
| 468,005 | 2/1982 | Newitt . | |
| 1,436,637 | 11/1922 | Bates . | |
| 2,300,392 | 11/1942 | Austin | 145/50 |
| 2,481,633 | 9/1949 | Wehner | 81/57 |
| 2,521,816 | 9/1950 | Adams | 74/127 |
| 2,737,983 | 3/1956 | Pray | 140/118 |
| 4,665,953 | 5/1987 | Randall | 140/118 |
| 4,842,025 | 6/1989 | Box et al. | 140/119 |

*Primary Examiner*—Lowell A. Larson
*Attorney, Agent, or Firm*—Calfee Halter & Griswold

[57] ABSTRACT

A reversible wire twisting plier tool is provided, which includes a pair of plier arms each having a jaw portion and a handle portion and which are pivotally interconnected and movable between an open position and a closed position. Plier rotating means are mounted on one of the handles. The rotating means includes a sleeve and a double spiral shank having a left hand groove and a right hand groove, axially slidably mounted within the sleeve. First and second gears are disposed within the sleeve, one gear being slidably engaged in one of said grooves and the other being slidably engaged in the other groove. A gear actuator is provided which is movable between a first actuated position wherein the actuator engages the first gear and a second actuated position wherein the actuator engages the second gear to selectively impart a clockwise or counterclockwise motion to the shaft depending upon which gear means is engaged. A slider is mounted on the sleeve and connected to the gear actuator. The slider is axially movable between first and second slider positions corresponding to the first and second actuated positions of the gear actuator. Means are also provided to releasably latch the pliers in the closed position and automatically release the pliers from the closed position upon squeezing thereof. Also preferably visible indicia are provided to display the relative rotational direction selected.

10 Claims, 5 Drawing Sheets

REVERSIBLE DIRECTION WIRE TWISTING PLIERS

FIELD OF THE INVENTION

This invention relates generally to plier type hand tools, and more particularly to plier-type hand tools adapted to perform a twisting operation on wires. In even more particular aspects, this invention relates to a wire twisting plier-type tool which can be easily and quickly set in either a clockwise or counterclockwise direction of twisting using a single hand. In still further aspects, this invention relates to a plier-type hand tool for twisting wire in either a clockwise or counter-clockwise direction, which requires digital intervention to lock onto a wire, and which will automatically release its locking position when squeezed.

BACKGROUND ART

There have been many different prior art patents relating to so-called wire twisting pliers, and several of these patents have addressed the question of reversible twisting or twisting in opposite directions, i.e., having the pliers capable of twisting either in a clockwise or counterclockwise direction.

One particular reversible type wire twisting plier is shown and described in U.S. Pat. No. 4,665,953 to Randall. This plier utilizes a conventional "yankee" mechanism mounted on one of the handles of a plier device, and incorporates the conventional "yankee" type flat sliding switch to reverse directions. This plier also incorporates an automatic locking feature wherein when the plier handles are squeezed to a closed position, the pliers automatically lock in this closed or gripping position and require digital intervention to allow for the opening of the pliers. This particular prior art device has several drawbacks. One drawback is the relative difficulty in accessing the reversing slide to reverse the direction of twisting and the absence of any readily visible or apparent indicia to indicate for which direction of rotation the pliers are set. Further, the locking feature on this plier automatically locks the pliers each time the handles are squeezed to close the jaws; and thus, every time the pliers are used whether or not for twisting, the pliers will lock in the closed position and require digital intervention for unlocking. This is time consuming especially in situations where a relatively minor portion of the use of the pliers is for twisting thus requiring positive unlocking every time the pliers are used.

Other devices which incorporate types of twisting include U.S. Pat. No. 2,737,983 to Prey. This patent also provides for twisting in a clockwise or counterclockwise direction but again utilizes a slide button for reversing.

Other types of rotating mechanisms are shown in U.S. Pat. No. 1,436,637 to Bates, U.S. Pat. No. 2,300,392 to Austin, U.S. Pat. No. 2,521,816 to Adams and U.S. Pat. No. 2,481,633 to Wehner. None of these patents show an actuator mechanism for reversing the direction and a locking mechanism which will not automatically lock upon closure.

SUMMARY OF THE INVENTION

Figure 1:
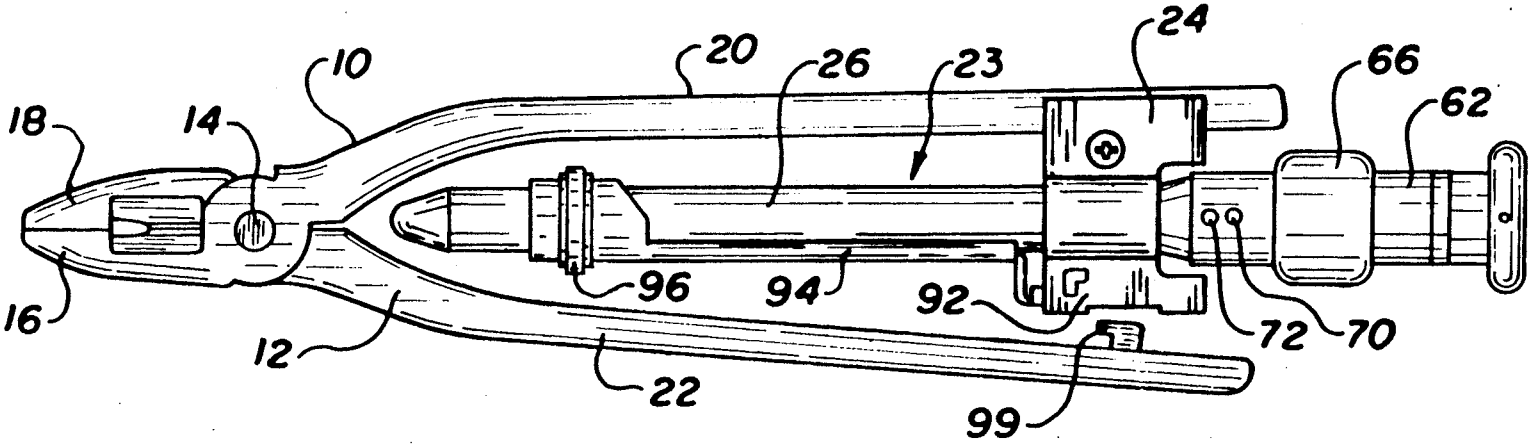
FIG. 1 is a side elevational view of one embodiment of a reversible twisting plier tool according to this invention showing the jaws closed but the handles unlatched.

According to the present invention a reversible wire twisting plier tool is provided. The tool includes a pair of plier arms each having a jaw portion and a handle portion. The plier arms are pivotally interconnected and movable between an open position and a closed position. Plier rotating means are provided and mounted on one of the handles. The plier rotating means includes a sleeve and a double spiral shank having a left hand groove and a right hand groove, the shank being axially slidably mounted within the sleeve. First and second gear means are disposed within the sleeve, one gear means being slidably engaged in one of said grooves and the other gear means being slidably engaged in the other of said grooves. Gear actuation means are provided which are operably associated with the sleeve and which are movable between a first actuated position wherein said gear actuation means engages the first gear means and a second actuated position wherein said gear actuation means engages the second gear means to thereby selectively impart a clockwise or counterclockwise motion to said shaft with respect to said sleeve depending upon which gear means is engaged. An annular slider is mounted on the sleeve externally thereof and is operably connected to the gear actuation means. The slider is axially movable on the sleeve between first and second slider positions corresponding to said first and second actuated positions of the gear actuation means. Means are also provided to releasably secure or latch said plier arms in the closed position and automatically release the pliers from the closed position upon squeezing thereof. Also, preferably visible indicia are provided to display the relative rotational direction selected.

DESCRIPTION OF THE PREFERRED EMBODIMENT

Referring now to the drawings and for the present to FIGS. 1 through 5, one embodiment of the reversible pliers according to the present invention is shown. The pliers include a pair of plier arms 10, 12 which are pivotally interconnected intermediate their opposite ends by means of a pivot pin 14. The plier arms 10 and 12 have respectively at one end thereof jaw portions 16, 18 and at the opposite end handle portions 20, 22, respectively. The handle portions and jaw portions are conventional and operate in a conventional manner for plier type hand tools. The pivot arms 10, 12 are pivotally movable between an open position and a closed position in a conventional manner.

Mounted on the handle portion 20 is a twisting mechanism designated generally by the reference character 23, the mounting thereon being by a bracket 24. Except for the actuating switch, which will be described in detail presently, the twisting mechanism as constituted is a conventional "yankee" type mechanism which is shown and described in detail in the Randall U.S. Pat. No. 4,665,953. The twisting mechanism includes a sleeve 26 which has disposed therein a shaft 28. The shaft 28 has a right hand groove 30 and a left hand groove 32 which in conjunction with gears and actuators, to be described presently, will impart either a left hand rotation of the shaft or a right hand rotation of the shaft with respect to the sleeve, i.e. either a clockwise or counterclockwise rotation. One end of the sleeve 26 terminates in a collar 34 having an internal cavity 36 and an axial bore 38 which bore 38 serves as a bearing surface to rotatably mount the shaft 28. A first gear member 40 is provided which has an internal land 42 that engages the groove 30 on the shaft 28. A second internal gear 44 is provided which has an internal land 46 that engages the left hand groove 32 of the shaft 28. A gear separator 48 is connected to the collar 34 and maintains the gears 40 and 44 separated and independently selectable for actuation.

Figure 2:
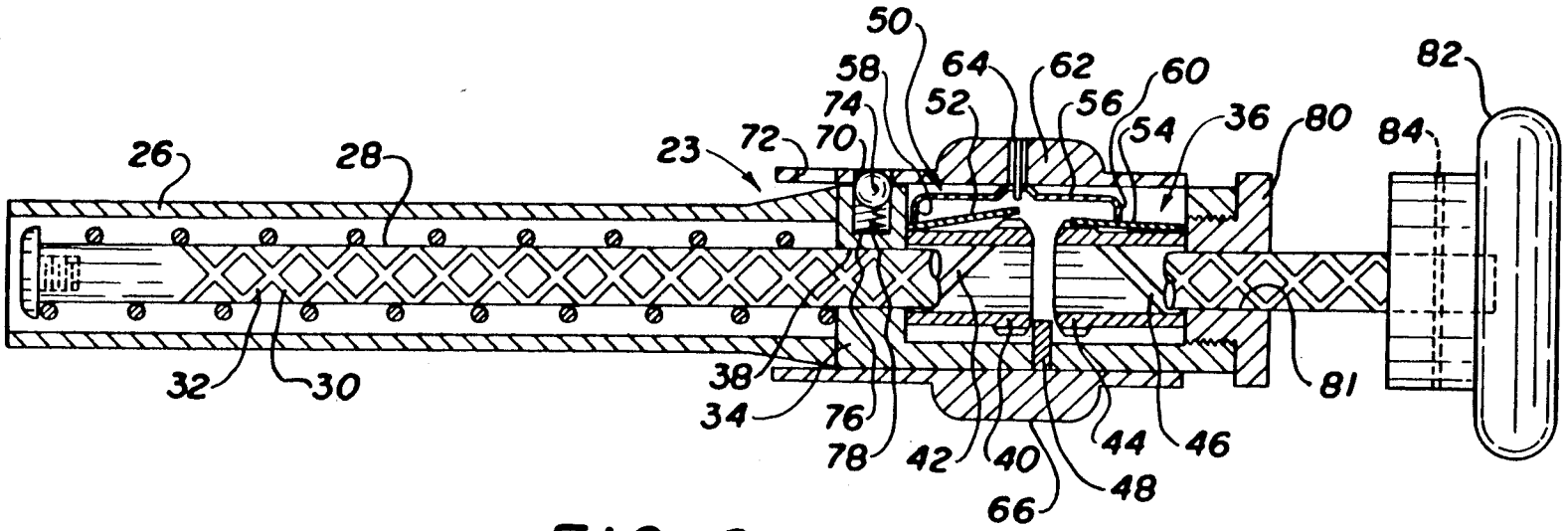
FIG. 2 is a longitudinal sectional view of the reversing mechanism of the present invention shown in position for actuation for twisting in one direction of rotation.
Figure 3:
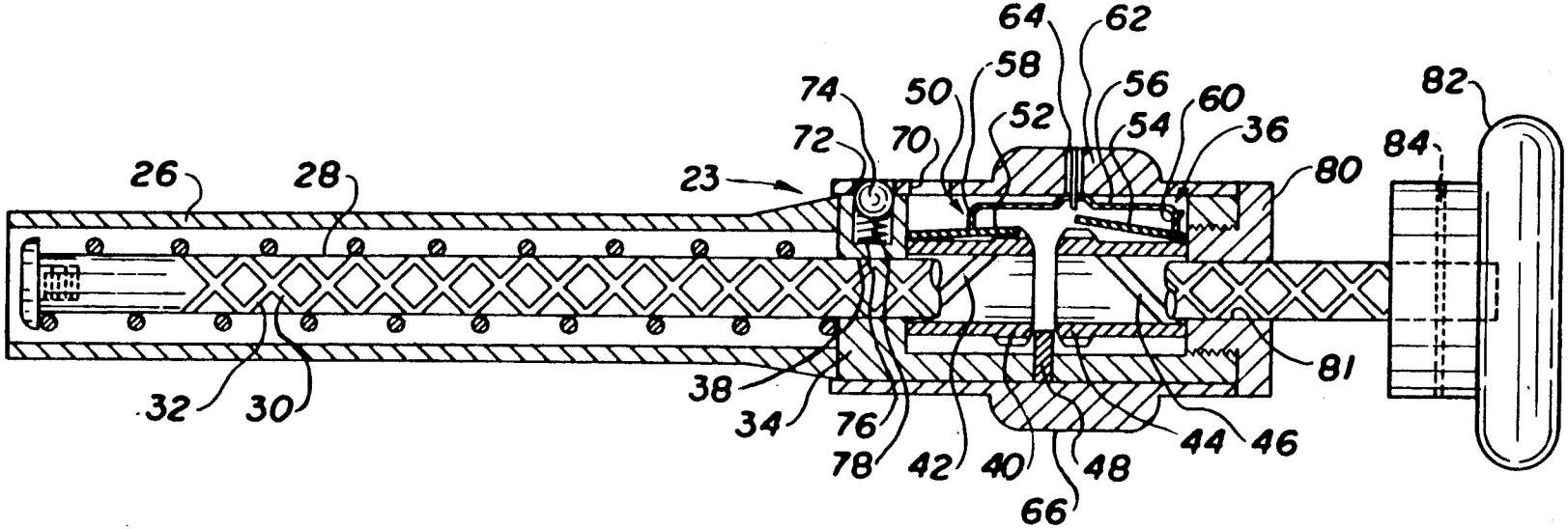
FIG. 3 is a longitudinal sectional similar to FIG. 2 showing the actuation position for twisting in the opposite direction from FIG. 2.

A gear actuator designated generally by the reference character 50 is provided which includes a first actuator plate 52 and a second actuator plate 54. The actuator plate 52 is selectively engageable with the gear 40 and the actuator plate 54 is selectively engageable with the gear 44. An actuator slide 56 is provided within the cavity 36 and includes a first leg 58 which engages the first actuator plate 52 and a second leg 60 which engages the second actuator plate 54. Movement of the actuator slide 56 between the positions shown in FIGS. 2 and 3 will selectively engage the actuator plate 52 with the gear 44 as shown in FIG. 2 or the actuator plate 52 with the gear 40 as shown in FIG. 3. (Conventionally, the outer ends of the actuator plates 52, 54 rest on tapered surfaces on the sleeve 26 (not shown) to allow for pivoting of the plate out of engagement with the respective gear 40 or 44.) When actuator plate 52 is engaged, the shaft 28 will rotate in one direction, and when actuation plate 54 is engaged, the shaft 28 will rotate in the opposition direction. To the extent the reversing mechanism has been described thus far, it is conventional and operates as shown and described in the Randall U.S. Pat. No. 4,665,953 and need not to be further described in detail since this portion of the mechanism is a conventional "yankee" type reversing mechanism found in reversing screwdrivers as indicated above and shown and described in the Randall patent.

The present invention incorporates a user-facile and position-identifiable mechanism for reversing the direction of rotation. This mechanism includes a generally barrel shaped annular slide member 62 slidably mounted on the outer surface of the collar 34 and axially movable thereon. The slide member 62 is secured to the actuating slide 56 by means of a pin 64 extending through the actuator slide 56 and the slide member 62. Further, the slide member 62 has a raised surface 66 formed thereon such that the slide member has an external configuration which is generally barrel shaped with a readily accessible gripping surface. The slide member 62 is provided with a pair of openings 70 and 72 which are axially spaced thereon. These openings 70 and 72 are disposed to coact with a ball 74 which is mounted in a bottomed bore 76 and biased outwardly by a coil spring 78. Thus, no matter what position the pliers are in, when they are gripped by the user a portion of the slide member 62 is readily accessible to the user's thumb or other finger and can be easily moved between the two positions shown in FIGS. 2 and 3. No fumbling is necessary to try to locate the small switch which is characteristic of the prior art reversing type mechanisms in which mechanism the switch may not be readily accessible to the user, depending on the position of the pliers when they are gripping the wire to be twisted.

Figure 2A:
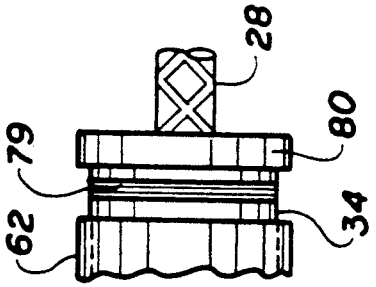
FIG. 2A is an elevational view of the end of the twisting mechanism set for twisting as shown in FIG. 2.
Figure 3A:
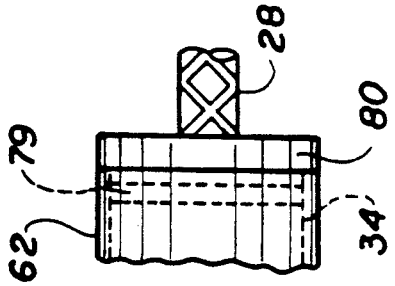
FIG. 3A is an elevational view of the end of the twisting mechanism set for twisting as shown in FIG. 3.

To complete the twisting device, an end plug 80 is threadably engaged to the end of the collar 34 which has a bore 81 which acts as a bearing surface supporting the shaft 28. A knob 82 is mounted to the end of the shaft by means of a pin 84. A spring 86 surrounds the shaft 28 and bears against one end of the collar 34 and also against the head of screw 88 threaded into the end of shaft 28. The action of the spring 86 will return the plier to the starting position after each pull on the knob 82 to cause a twisting operation. To provide a visual indication of the direction of rotation which has been selected, a contrasting color stripe 79 is formed around the end of the collar 34 adjacent the end plug 80. This stripe 79 is visible when the slide member 62 is in the position shown in FIG. 2A but is covered when the slide member is in the position shown in FIG. 3A. Thus, when the stripe 79 is visible or showing, the shaft will be set for twisting in one direction and when the stripe 79 is covered and thus not visible, the shaft will twist in the opposite direction.

Figure 4:
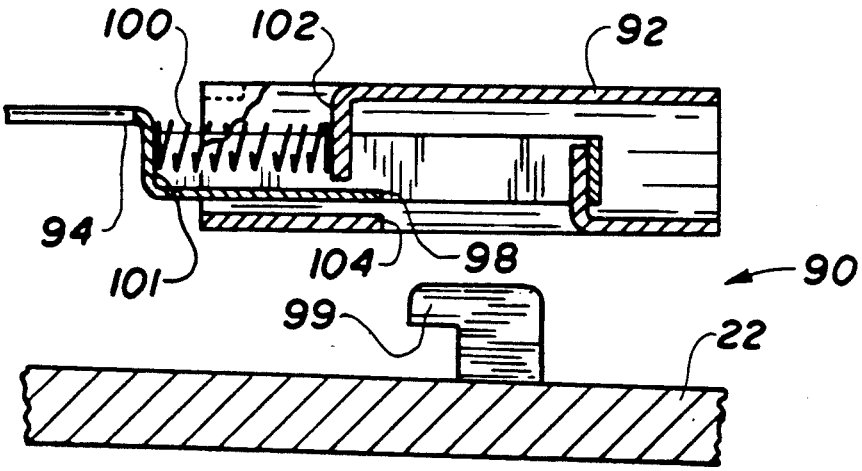
FIG. 4 is a longitudinal sectional view of the locking portion of the device of FIGS. 1-3 in the open position.
Figure 5:
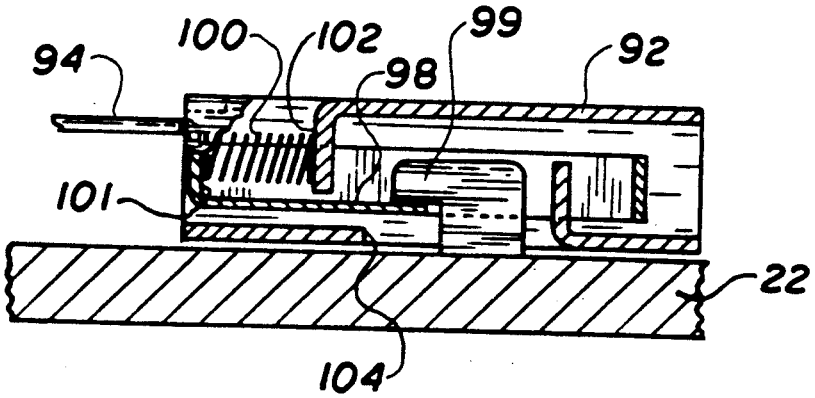
FIG. 5 is a longitudinal sectional view similar to FIG. 4 of the locking device in the latched or locked position.

The pliers are also provided with a latching mechanism designated generally by the reference character 90. The latching mechanism is shown in the unlatched position in FIG. 4 and the closed, or latched, or locked, position in FIG. 5. The latching mechanism includes a housing 92 formed on one side of the bracket 24, which housing 92 slidably mounts a latch lever 94. The end of the latch lever 94 is formed with a thimble 96 surrounding the sleeve 26 (FIG. 1) which can be reached by the thumb of an operator. The latch lever 94 includes a latch plate 98 adapted to engage a catch 99 formed on the handle position 22. A coil spring 100 is captivated between shoulder 101 on the latch lever 94 and a surface 102 on housing 92. A slot or opening 104 is formed in the housing 92 to receive the catch 99. The spring 100 normally biases the latch lever 94 to the left as seen in FIGS. 1, 4, and 5 leaving the slot 104 open for the receipt of the catch 99 (FIG. 4). When the handles 20, 22 are squeezed together after the jaws 16, 18 have been closed, the resiliency of the handles will cause the catch 99 to enter the slot 104. To lock or latch the pliers, the operator engages the thimble 96 with his or her thumb and slides the latch lever to the right (as seen in FIGS. 1, 4, and 5). By slightly releasing pressure on the handles 20, 22, the catch 99 engages the latch plate 98 as shown in FIG. 5, and the resiliency of the handles 20, 22 maintains the latch 99 in contact with the latch plate 98, and the friction between the latch plate 98 and catch 99 maintains the pliers latched or closed.

To release the pliers from the latched position, one merely need squeeze the handles of the pliers together which will move the catch 99 out of contact with the latch plate 98. The urging of the spring 100 will then move the slidable latch lever 94 to the left moving the latch plate 98 out of the slot 104, thus, allowing the pliers to open and close and operate in a normal manner.

In order to operate the pliers for twisting of wire one first grasps the pliers in the conventional manner, squeezes them, gripping the wires to be twisted by closing the jaws down on the wires. The handles 20, 22 are continued to be squeezed together to such a position where the catch 99 is in the slot 104. The slidable latch lever 94 is then moved by manipulating the thimble 96 to lock the pliers in their closed position. The slide 62 is then moved to either the position shown in FIGS. 2 and 2A or FIGS. 3 and 3A depending upon which direction of rotation of the pliers is desired (of course, this selection can be made before the wires are gripped). In one position (FIGS. 2 and 2A), the colored stripe 79 will be visible, in the other (FIGS. 3 and 3A), it will not. When the slide member 62 is moved to the position being shown in either FIGS. 2 and 2A or FIGS. 3 and 3A, it will give the desired direction of rotation. If the user wants to quickly determine which direction of rotation has been selected, he or she need merely look at the sleeve to see if the colored stripe 79 is visible which will indicate that it will rotate in one direction and if it is not visible, it will rotate in the opposite direction.

Figure 6:
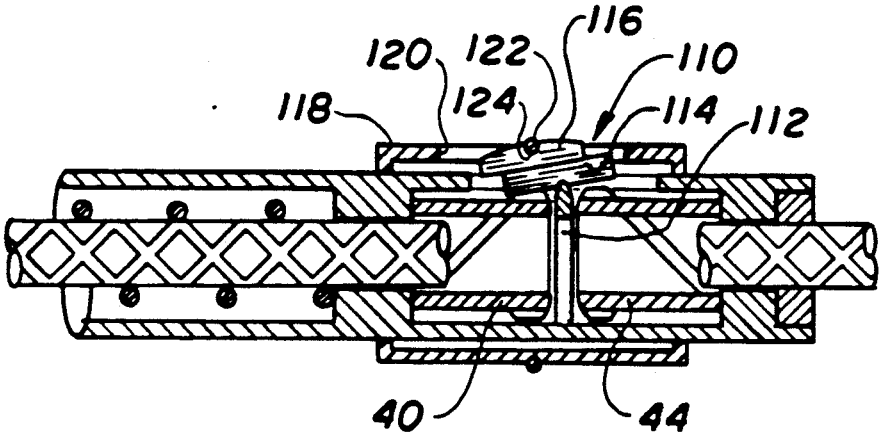
FIG. 6 is a longitudinal sectional view of another embodiment of a reversing mechanism of the present invention shown in position for actuation for twisting in one direction of rotation.
Figure 7:
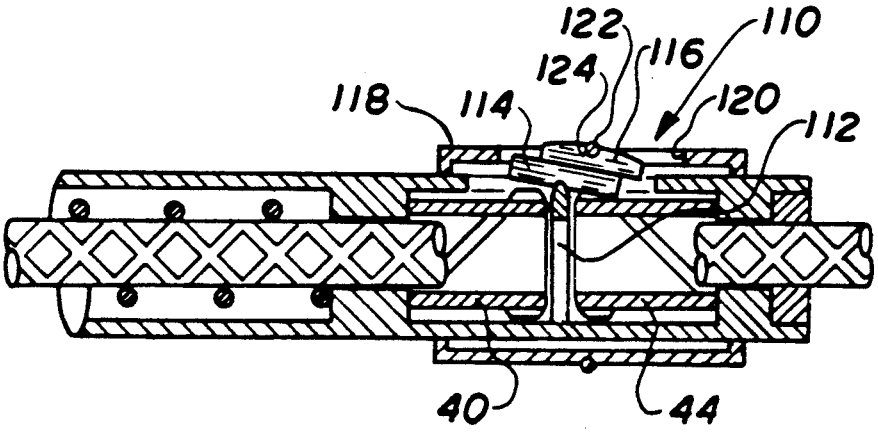
FIG. 7 is a longitudinal sectional view similar to FIG. 6 showing the actuation position for twisting in the opposite direction from that of FIG. 6.

Referring now to FIGS. 6 and 7, another embodiment of a gear actuator used in this invention is shown. In this embodiment, the sleeve, the shaft, the gears and gear separator are all the same as previously described, the difference being in the particular gear actuator.

Figure 8:
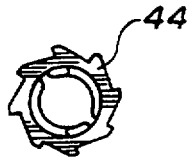
FIG. 8 is an end elevational view of one gear member of the device.
Figure 9:
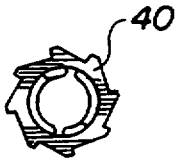
FIG. 9 is an end elevational view of another gear member of the device.
Figure 10:
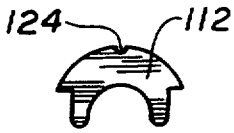
FIG. 10 is a front elevational view of the yoke member of the device of FIGS. 6 and 7.
Figure 11:
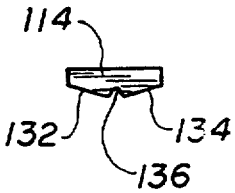
FIG. 11 is a front elevational view of the rocker arm of the devices of FIGS. 6 and 7.
Figure 12:
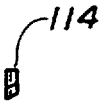
FIG. 12 is an end elevational view of the rocker arm of FIG. 11.

In this embodiment, the gear actuator mechanism 110 includes a generally C-shaped yoke member 112 positioned between the gears 40 and 44 and residing in a slot (not shown) in sleeve 126. The yoke member 112 serves as a gear separator to separate gears 40 and 44 and also mounts a rocker arm 114 for pivoting motion thereon. The rocker arm 114 is actuated by a cam 116 which is secured to slider 118 in a slot 120 formed in the slider 118 and held therein by a clip ring 122 engaging in groove 124 of the rocker arm 114. The slot has opposite tapered ends 128, 130. The slider 118 is movable axially on the shaft as previously described and the action of the cam 116 on the rocker arm 114 will cause either one end of the rocker arm to engage gear 40 or the other end of the rocker arm to engage gear 44. The rocker has tapered surfaces 132, and 134 to facilitate gear engagement, the surface being on opposite sides of groove 136 which positions the rocker arm on yoke 112. The action of the engagement of the gears is similar to the action in the previously described embodiment of the actuator plates 52 and 54 in that the gear that is engaged is prevented from rotation with respect to the shaft so that the shaft will rotate with respect to the sleeve in the direction determined by the engagement of the gear 40 or engagement of the gear 44. These gears are shown in FIGS. 8 and 9 looking to the left and right from between the gears respectively.

Again this embodiment provides a facilely actuatable sliding device for easy change of rotational direction; also in this embodiment, a color stripe can be supplied as in the previous embodiment. Further in this embodiment, the latching mechanism is the same as described in the previously described embodiment.

While several embodiments of this invention have been shown and described various adaptations and modifications can be made without departing from the scope of the invention as defined in the appended claims.

Having thus described the preferred embodiment, the invention is now claimed to be:

1. Reversible wire twisting pliers comprising a pair of plier arms each having a jaw portion and a handle portion;

said arms being pivotally interconnected for movement between an open position and a close position;

plier rotating means mounted on one of said handle portions, said plier rotating means including a sleeve and a double spiral shaft having a left hand groove and a right hand groove formed therein, said shaft being axially slidably mounted within said sleeve;

first and second gear means carried within said sleeve, said first gear means being slidably engaged in one groove in said shaft and said other gear means being slidably engaged in the other groove in said shaft;

gear actuation means operably associated with said gear means and said sleeve and movable between a first actuated position wherein said first gear means is engaged and a second actuated position wherein said second gear means is engaged and wherein the engaged gear in the first actuated position will impart a clockwise motion and the gear engaged in the second actuated position will impart a counterclockwise motion of the sleeve with respect to said shaft;

a slider member mounted externally on said sleeve operatively connected to said gear actuator means, said slider being axially movable on said first and second gear actuated positions;

and means to releasably secure said plier arms in said closed position.

2. The device as defined in claim 1 further characterized by detent means configured and disposed to releasably secure said slider in at least one of said first and second slider positions.

3. The device as defined in claim 2 wherein said detent means is configured to releasably secure said slider in each of said first and second positions.

4. The device as defined in claim 1 further characterized by indicator means to convey to the operator the position of said slider.

5. The device as defined in claim 4 wherein said indicator means includes indicia visible at only one of said slider positions.

6. The device as defined in claim wherein said gear actuating means includes a rocker arm and means to pivotally move said rocker arm between a first position wherein said rocker arm engages said first gear means and a second position wherein said rocker arm engages said second gear means.

7. The device as defined in claim 6 wherein said gear actuator means for actuating said rocker arm includes a cam member carried by said slider and operative against said rocker arm.

8. The device as defined in claim 7 wherein said rocker arm is pivotally mounted on a yoke member mounted on a sleeve intermediate said first and second gear means.

9. The device as defined in claim 1 wherein said slider member includes a portion at least partially surrounding said sleeve.

10. The device as defined in claim 1 wherein said slider member includes a raised portion accessible to a user's thumb when the user is grasping the pliers.

* * * * *

UNITED STATES PATENT AND TRADEMARK OFFICE

CERTIFICATE OF CORRECTION

PATENT NO. : 5,211,209

DATED : May 18, 1993

INVENTOR(S) : Ronald J. Geibel and Maureen A. Geibel

It is certified that error appears in the above-identified patent and that said Letters Patent is hereby corrected as shown below:

The sheets of drawings, consisting of Figs. 8-12 should be deleted to appear as per attached Figs. 8-12.

Col. 6, line 63 after "claim" insert --1--.

Signed and Sealed this

Sixteenth Day of July, 1996

*Attest:*

*Attesting Officer*

Bruce Lehman

BRUCE LEHMAN

*Commissioner of Patents and Trademarks*